US006781556B2

(12) United States Patent
Kojima et al.

(10) Patent No.: US 6,781,556 B2
(45) Date of Patent: Aug. 24, 2004

(54) BUILT-IN ANTENNA APPARATUS

(75) Inventors: Suguru Kojima, Yokosuka (JP); Hideo Ito, Machida (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/380,699

(22) PCT Filed: Jul. 23, 2002

(86) PCT No.: PCT/JP02/07408

§ 371 (c)(1),
(2), (4) Date: Mar. 17, 2003

(87) PCT Pub. No.: WO03/010850

PCT Pub. Date: Feb. 6, 2003

(65) Prior Publication Data

US 2004/0021608 A1 Feb. 5, 2004

(30) Foreign Application Priority Data

Jul. 25, 2001 (JP) ..... 2001-225104
Mar. 22, 2002 (JP) ..... 2002-80569

(51) Int. Cl.[7] ..... H01Q 19/10
(52) U.S. Cl. ..... 343/818; 343/702; 343/795
(58) Field of Search ..... 343/700 MS, 702, 343/795, 803, 806, 810, 815, 817, 818

(56) References Cited

U.S. PATENT DOCUMENTS 4,812,855 A * 3/1989 Coe et al. ..... 343/818
6,046,703 A 4/2000 Wang et al. ..... 343/795
6,281,843 B1 * 8/2001 Evtioushkine et al. ..... 343/700 MS
6,326,922 B1 * 12/2001 Hegendoerfer ..... 343/700 MS

FOREIGN PATENT DOCUMENTS

| | | |
|---|---|---|
| EP | 1111718 | 6/2001 |
| EP | 1154513 | 11/2001 |
| JP | 61205004 | 9/1986 |
| JP | 08335818 | 12/1996 |
| JP | 11274845 | 10/1999 |
| JP | 2000004120 | 1/2000 |
| JP | 2000349526 | 12/2000 |
| JP | 2001077611 | 3/2001 |
| JP | 2001085920 | 3/2001 |
| JP | 2002151923 | 5/2002 |
| WO | 0148860 | 7/2001 |

OTHER PUBLICATIONS

International Search Report dated Sep. 10, 2002.

* cited by examiner

*Primary Examiner*—Hoang V. Nguyen
(74) *Attorney, Agent, or Firm*—Stevens, Davis, Miller & Mosher, LLP

(57) ABSTRACT

A built-in antenna device that broadens bandwidth and that realizes further miniaturization and thin-modeling without making a device itself a flat shape, while still enhancing gain and reducing SAR (specific Absorption Rate). The self impedance of dipole antenna 12, the self impedance of parasitic element 14, and the mutual impedance between dipole antenna 12 and parasitic element 14 change as the length and girth of dipole antenna 12 and parasitic element 14, and the distance therebetween are adjusted to predetermined levels, so as to broaden bandwidth by changing the input impedance of built-in antenna 10.

26 Claims, 6 Drawing Sheets

BUILT-IN ANTENNA APPARATUS

TECHNICAL FIELD

The present invention relates to built-in antennas.

BACKGROUND ART

In recent years, communication devices such as mobile terminal devices have steadily spread, and there has been a demand for miniaturization of communication devices. There has also been a demand for miniaturization and thin-modeling of built-in antenna devices that are built in these communication devices.

These built-in antenna devices should be able to operate at a wide bandwidth, within the bandwidth that is required by the mobile communication systems in which communications terminals such as mobile terminal devices are used.

Japanese laid-open patent publication No. 2000-349526 discloses an example of built-in antenna device of the above type. This built-in antenna aims to broaden bandwidth and, at the same time, aims at miniaturization and thin-modeling, by configuring an elongated antenna element into a continuous surface of a zigzag shape and such, without excessively shortening the length of its central axis length (antenna length), or by providing electro-magnetic wave absorbing material of a certain width near the antenna element.

Nevertheless, with a typical built-in antenna device, an antenna element has a continuous surface, or, a built-in antenna itself has a flat shape to have electro-magnetic wave absorbing material of a certain width provided, and thus a certain width is required and miniaturization and thin-modeling are limited.

Furthermore, an antenna needs to operate at a wide bandwidth and enhance gain during communication to utilize the frequency band used by a system, and yet a single antenna element can enhance gain only to a limited extent.

DISCLOSURE OF INVENTION

The present invention is therefore directed to broadening bandwidth, and realizing further miniaturization and thin modeling without making the whole device in a flat shape.

In addition to the miniaturization and thin modeling that does not require making the whole device a flat shape, the present invention is directed to enhancing gain and reducing SAR (Specific Absorption Rate).

The essence of the present invention is to broaden bandwidth and to make a built-in antenna device small and thin, by positioning a power-supplied radiation element and a parasitic element for use in matching in opposition to each other, and without making the radiation element a flat shape such as a thick board shape.

One aspect of the invention presented herein is a built-in antenna device comprising: a radiation element of a dipole configuration that is supplied power and provided on a circuit board, both ends of the radiation element turned in a same direction; a parasitic element for use in matching provided opposite to the radiation element, both ends of said parasitic element bent to the same direction as the both ends of the radiation element; and a case current suppressor provided in a power supply part of the radiation element to suppress a case current.

Another aspect of the invention presented herein is a built-in antenna device comprising: a radiation element of a dipole configuration that is supplied power and provided on a circuit board, both ends of the radiation element turned in a same direction; a parasitic element for use in matching provided opposite to the radiation element, one end of said parasitic element bent to the same direction as the both ends of the radiation element, and the other end bent to an opposite direction; and a case current suppressor provided in a power supply part of the radiation element to suppress a case current.

Yet another aspect of the invention presented herein is a built-in antenna device comprising: a radiation element of a dipole configuration that is supplied power and provided on a circuit board, both ends of the radiation element turned in a same direction; a parasitic element for use in matching provided opposite to the radiation element, only one end of the parasitic element bent to the same direction as the both ends of the radiation element; and a case current suppressor provided in a power supply part of the radiation element to suppress a case current.

Yet another aspect of the invention presented herein is a built-in antenna device comprising: a radiation element of a dipole configuration that is supplied power and provided on a circuit board, both ends of the radiation element turned in a same direction; a parasitic element for use in matching provided opposite to the radiation element, one end of the parasitic element bent to the same direction as the both ends of the radiation element, and the other end bent to a direction that is perpendicular to a plane of the circuit board; and a case current suppressor provided in a power supply part of the radiation element to suppress a case current.

Yet another aspect of the invention presented herein is a built-in antenna device comprising: a radiation element of a dipole configuration that is supplied power and provided on a circuit board, both ends of the radiation element turned in a same direction; a parasitic element for use in matching provided near the radiation element on the circuit board; and a case current suppressor provided in a power supply part of the radiation element to suppress a case current.

Yet another aspect of the invention presented herein is a built-in antenna device comprising: a radiation element of a dipole configuration that is supplied power and provided on a circuit board, both ends of the element turned in a same direction; a case, at least a portion of which that is opposite to the radiation element over the circuit board is made of steel; and a case current suppressor provided in a power supply part of the radiation element to suppress a case current.

Yet another aspect of the invention presented herein is a built-in antenna device comprising: a radiation element of a dipole configuration that is supplied power and provided on a circuit board, both ends of the radiation element turned in mutually opposite directions; a case, at least a portion oh which that is opposite to the radiation element over the circuit board is made of steel; and a case current suppressor provided in a power supply part of the radiation element to suppress a case current.

BEST MODE FOR CARRYING OUT THE INVENTION

With reference to the accompanying drawings now, preferred embodiments of the present invention will be described below.

First Embodiment

Figure 1:
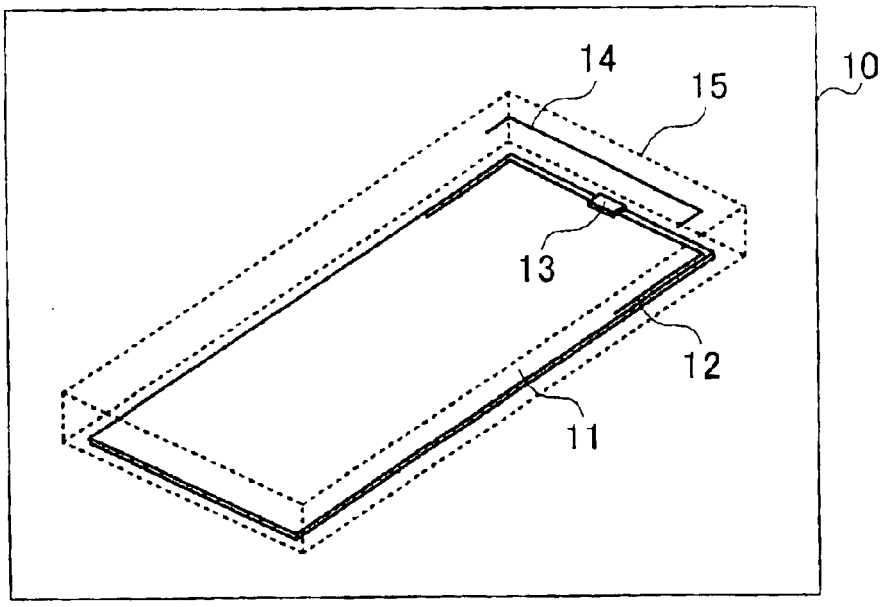
FIG. 1 shows a configuration of a built-in antenna device according to the first embodiment of the present invention.

FIG. 1 shows a configuration of a built-in antenna device according to the first embodiment of the present invention.

Built-in antenna device 10 comprises circuit board 11, dipole antenna (radiation element) 12, balun 13, parasitic element 14, and case 15. Hereinafter the length direction of case 15 shall be construed such that the direction where dipole antenna 12, balun 13, and parasitic element 14 lie is the depth side, and the direction where dipole antenna 12, balun 13, and parasitic element 14 are not provided is the front side.

Dipole antenna 12 is provided on circuit board 11, and both ends thereof are bent in the direction of the front side. In a power supply part around the middle of dipole antenna 12, balun 13 is provided, which is balance-unbalance converter that prevents antenna currents from flowing onto circuit board 11 or onto case 15. Moreover, parasitic element 14 is provided on the inner wall of case 15 in direct opposition to dipole antenna 12 on circuit board 11. Like dipole antenna 12, both ends of parasitic element 15 are bent in the direction of the front side of case 15.

Given built-in antenna device 10 with the above configuration, it is possible to adjust the length and the girth of dipole antenna 12 and parasitic element 14 and the distance therebetween to predetermined levels, so as to subject the self impedance of dipole antenna 12, the self impedance of parasitic element 14, and the mutual impedance between dipole antenna 12 and parasitic element 14 to change. By this means, the input impedance of built-in antenna 10 can also be subjected to change so as to broaden bandwidth.

The present embodiment is thus capable of broadening bandwidth, and further miniaturization and thin modeling of a built-in antenna device, without modifying the shape of a dipole antenna element in a thick board shape or such.

Second Embodiment

One principal feature of the built-in antenna device of the second embodiment of the present invention is that both ends of a parasitic element are bent in opposite directions so as to make possible the transmission and reception of vertical polarized waves in the length direction of a case.

Figure 2:
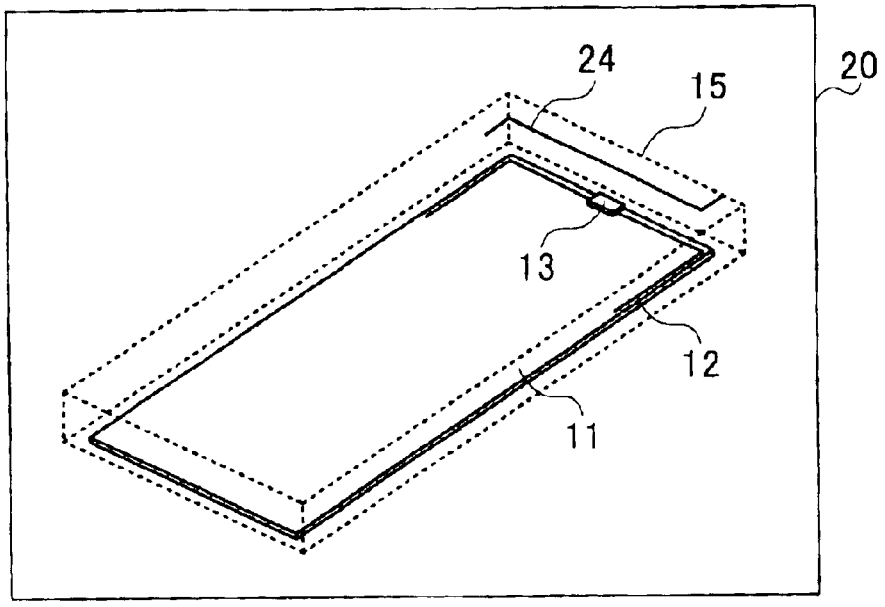
FIG. 2 shows a configuration of a built-in antenna device according to the second embodiment of the present invention.

FIG. 2 shows a configuration of a built-in antenna device according to the second embodiment of the present invention. Parts in FIG. 2 identical to those of FIG. 1 are assigned the same numerals as in FIG. 1 without further explanations.

Built-in antenna device 20 comprises circuit board 11, dipole antenna 12, balun 13, parasitic element 24, and case 15. Hereinafter the length direction of case 15 shall be construed such that the direction where dipole antenna 12, balun 13, and parasitic element 24 lie is the depth side, and the direction where dipole antenna 12, balun 13, and parasitic element 24 are not provided is the front side.

Parasitic element 24 is provided on the inner wall of case 15 in direct opposition to dipole antenna 12 on circuit board 11. Like dipole antenna 12, one end of parasitic element 24 is bent in the direction of the front side of case 15, while the other end is bent in the depth side of case 15, which is contrary to dipole antenna 12.

Given built-in antenna device 20 with the above configuration, it is possible to adjust the length and the girth of dipole antenna 12 and parasitic element 24 and the distance therebetween to predetermined levels, so as to subject the self impedance of dipole antenna 12, the self impedance of parasitic element 24, and the mutual impedance between dipole antenna 12 and parasitic element 24 to change. By this means, the input impedance of built-in antenna 20 can also be subjected to change so as to broaden bandwidth.

Moreover, one end of parasitic element 24 is bent in the direction of the front side of case 15 like dipole antenna 12, while the other end is bent in the depth side of case 15, which is contrary to dipole antenna 12, thereby making possible the transmission and reception of vertical polarized waves in the length direction of the case without creating antiphase antenna currents in the length direction of the case.

The present embodiment is thus capable of broadening bandwidth, and further miniaturization and thin modeling of a built-in antenna device, without modifying the shape of a dipole antenna element in a thick board shape or such. Moreover, the transmission/reception of vertical polarized waves in the length direction of a case is made possible.

Third Embodiment

One principal feature of the built-in antenna device of the third embodiment of the present invention is that one end of a parasitic element is bent, while the other end is kept unbent, so as to make possible the transmission and reception of vertical polarized waves in the length direction of a case.

Figure 3:
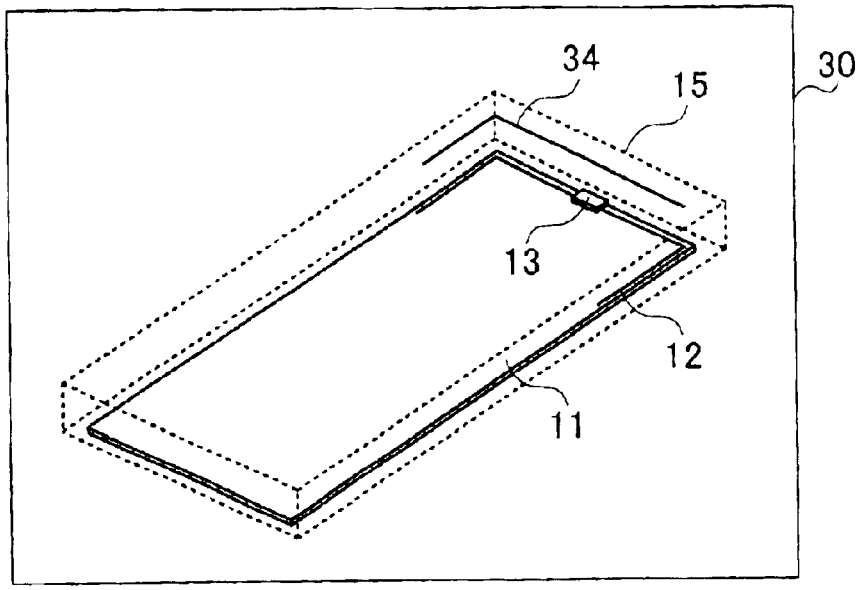
FIG. 3 shows a configuration of a built-in antenna device according to the third embodiment of the present invention.

FIG. 3 shows a configuration of a built-in antenna device according to the third embodiment of the present invention. Parts in FIG. 3 identical to those of FIG. 1 are assigned the same numerals as in FIG. 1 without further explanations.

Built-in antenna device 30 comprises circuit board 11, dipole antenna 12, balun 13, parasitic element 34, and case 15. Hereinafter the length direction of case 15 shall be construed such that the direction where dipole antenna 12, balun 13, and parasitic element 34 lie is the depth side, and the direction where dipole antenna 12, balun 13, and parasitic element 34 are not provided is the front side.

Parasitic element 34 is provided on the inner wall of case 15 in direct opposition to dipole antenna 12 on circuit board 11. Like dipole antenna 12, one end of parasitic element 34 is bent in the direction of the front side of case 15, while the other end is not bent, so that parasitic element 34 as a whole makes an L shape.

Given built-in antenna device 30 with the above configuration, it is possible to adjust the length and the girth of dipole antenna 12 and parasitic element 34 and the distance therebetween to predetermined levels, so as to subject the self impedance of dipole antenna 12, the self impedance of parasitic element 34, and the mutual impedance between dipole antenna 12 and parasitic element 34 to change. By this means, the input impedance of built-in antenna 30 can also be subjected to change so as to broaden bandwidth.

Moreover, one end of parasitic element 34 is bent in the direction of the front side of case 15 like dipole antenna 12, while the other end is not bent, so that parasitic element 34 as a whole makes an L shape. By this means, the transmission/reception of vertical polarized waves in the length direction of the case is made possible without creating antiphase antenna currents in the length direction of the case.

The present embodiment is thus capable of broadening bandwidth, and further miniaturization and thin modeling of a built-in antenna device, without modifying the shape of a dipole antenna element in a thick board shape or such. Moreover, the transmission/reception of vertical polarized waves in the length direction of a case is made possible.

Fourth Embodiment

One principal feature of the built-in antenna device of the fourth embodiment of the present invention is that one end of a parasitic element is bent perpendicularly towards the plane of a circuit board, so as to make possible the transmission and reception of vertical polarized waves in the length direction and in the thickness direction of a case.

Figure 4:
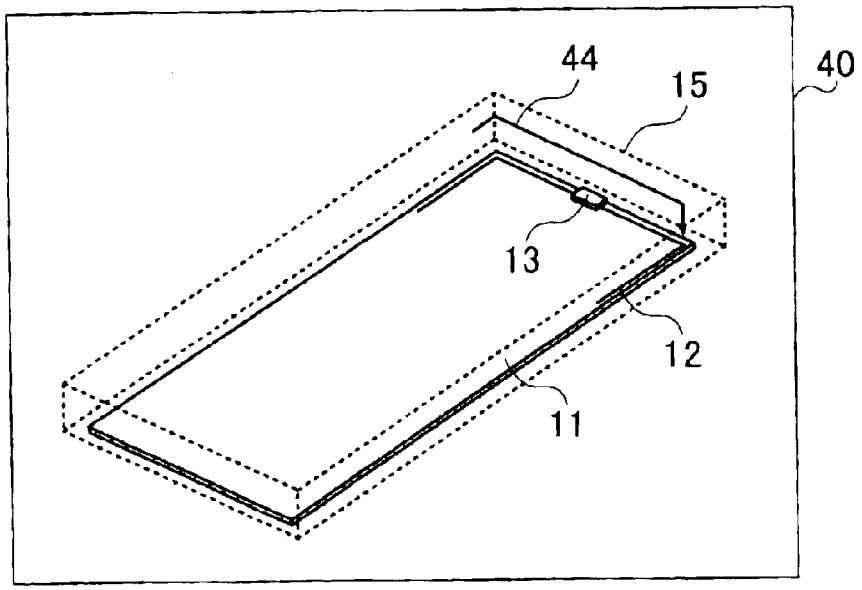
FIG. 4 shows a configuration of a built-in antenna device according to the fourth embodiment of the present invention.

FIG. 4 shows a configuration of a built-in antenna device according to the fourth embodiment of the present invention. Parts in FIG. 4 identical to those of FIG. 1 are assigned the same numerals as in FIG. 1 without further explanations.

Built-in antenna device 40 comprises circuit board 11, dipole antenna 12, balun 13, parasitic element 44, and case 15. Hereinafter the length direction of case 15 shall be construed such that the direction where dipole antenna 12, balun 13, and parasitic element 44 lie is the depth side, and the direction where dipole antenna 12, balun 13, and parasitic element 44 are not provided is the front side.

Parasitic element 44 is provided on the inner wall of case 15 in direct opposition to dipole antenna 12 on circuit board 11. Like dipole antenna 12, one end of parasitic element 44 is bent in the direction of the front side of case 15, while the other end is bent perpendicularly towards the plane of circuit board 11.

Given built-in antenna device 40 with the above configuration, it is possible to adjust the length and the girth of dipole antenna 12 and parasitic element 44 and the distance therebetween to predetermined levels, so as to subject the self impedance of dipole antenna 12, the self impedance of parasitic element 44, and the mutual impedance between dipole antenna 12 and parasitic element 44 to change. By this means, the input impedance of built-in antenna 40 can also be subjected to change so as to broaden bandwidth.

Moreover, one end of parasitic element 44 is bent in the direction of the front side of case 15 like dipole antenna 12, while the other end is bent perpendicularly towards the plane of circuit board 11. By this means, the transmission/reception of vertical polarized waves in the length direction and in the thickness direction of the case is made possible without creating antiphase antenna currents in the length direction and in the thickness direction of the case.

The present embodiment is thus capable of broadening bandwidth, and further miniaturization and thin modeling of a built-in antenna device, without modifying the shape of a dipole antenna element in a thick board shape or such. Moreover, the transmission/reception of vertical polarized waves in the length direction and in the thickness direction of a case is made possible.

Fifth Embodiment

One principal feature of the built-in antenna device of the fifth embodiment of the present invention is that a middle portion of a dipole antenna is bent perpendicularly towards the plane of a circuit board, so as to make possible the transmission and reception of vertical polarized waves in the thickness direction of a case.

Figure 5:
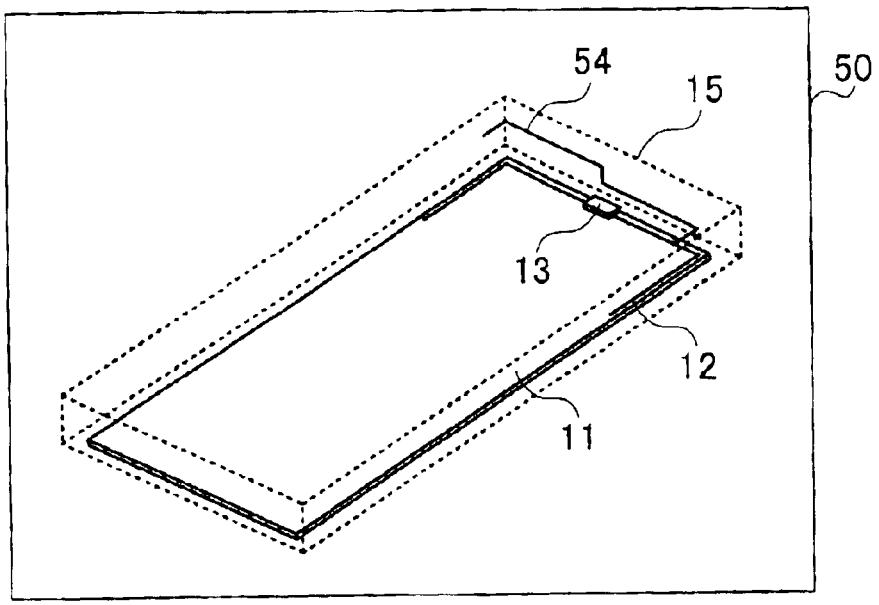
FIG. 5 shows a configuration of a built-in antenna device according to the fifth embodiment of the present invention.

FIG. 5 shows a configuration of a built-in antenna device according to the fifth embodiment of the present invention. Parts in FIG. 5 identical to those of FIG. 1 are assigned the same numerals as in FIG. 1 without further explanations.

Built-in antenna device 50 comprises circuit board 11, dipole antenna 12, balun 13, parasitic element 54, and case 15. Hereinafter the length direction of case 15 shall be construed such that the direction where dipole antenna 12, balun 13, and parasitic element 54 lie is the depth side, and the direction where dipole antenna 12, balun 13, and parasitic element 54 are not provided is the front side.

Parasitic element 54 is provided on the inner wall of case 15 in direct opposition to dipole antenna 12 on circuit board 11. Like dipole antenna 12, both ends of parasitic element 54 are bent in the direction of the front side of case 15. In addition, a middle portion of parasitic element 54 is bent perpendicularly towards the plane of the circuit board.

Given built-in antenna device 50 with the above configuration, it is possible to adjust the length and the girth of dipole antenna 12 and parasitic element 54 and the distance therebetween to predetermined levels, so as to subject the self impedance of dipole antenna 12, the self impedance of parasitic element 54, and the mutual impedance between dipole antenna 12 and parasitic element 54 to change. By this means, the input impedance of built-in antenna 50 can also be subjected to change so as to broaden bandwidth.

Moreover, both ends of parasitic element 54 are bent in the direction of the front side of case 15 like dipole antenna 12, and, in addition, a middle portion of parasitic element 54 is bent perpendicularly towards the plane of the circuit board. By this means, the transmission/reception of vertical polarized waves in the thickness direction of the case is made possible without creating antiphase antenna currents in the thickness direction of the case.

The present embodiment is thus capable of broadening bandwidth, and further miniaturization and thin modeling of a built-in antenna device, without modifying the shape of a dipole antenna element in a thick board shape or such. Moreover, the transmission/reception of vertical polarized waves in the thickness direction of a case is made possible.

Sixth Embodiment

One principal feature of the built-in antenna device of the sixth embodiment of the present invention is that both ends of a parasitic element are bent in mutually opposite directions and that a middle portion of the parasitic element is bent perpendicularly towards the plane of a circuit board, so as to make possible the transmission and reception of vertical polarized waves in the length direction and in the thickness direction of a case.

Figure 6:
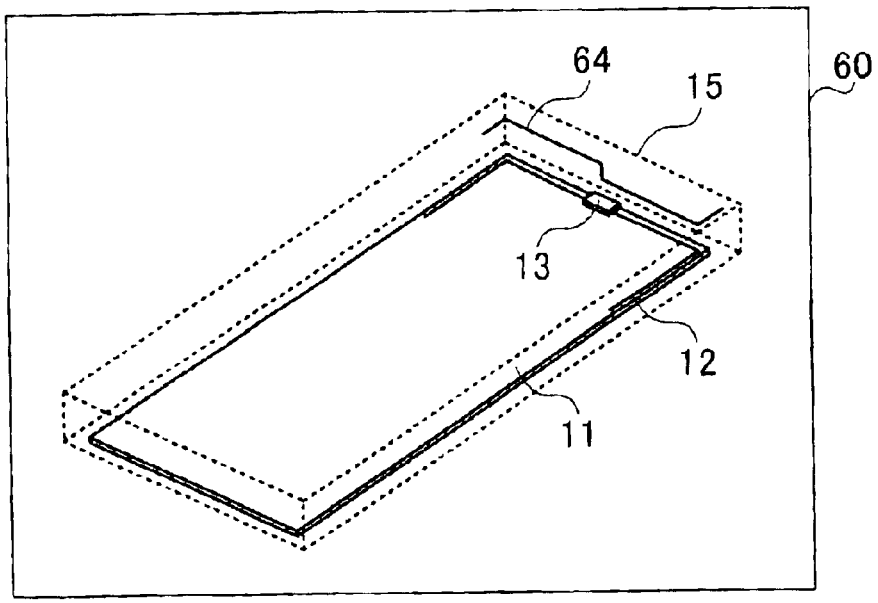
FIG. 6 shows a configuration of a built-in antenna device according to the sixth embodiment of the present invention.

FIG. 6 shows a configuration of a built-in antenna device according to the sixth embodiment of the present invention. Parts in FIG. 6 identical to those of FIG. 1 are assigned the same numerals as in FIG. 1 without further explanations.

Built-in antenna device 60 comprises circuit board 11, dipole antenna 12, balun 13, parasitic element 64, and case 15. Hereinafter the length direction of case 15 shall be construed such that the direction where dipole antenna 12, balun 13, and parasitic element 64 lie is the depth side, and the direction where dipole antenna 12, balun 13, and parasitic element 64 are not provided is the front side.

Parasitic element 64 is provided on the inner wall of case 15 in direct opposition to dipole antenna 12 on circuit board 11. Like dipole antenna 12, one end of parasitic element 64 is bent in the direction of the front side of case 15, while the other end is bent in the depth side of case 15, which is contrary to dipole antenna 12. In addition, a middle portion of parasitic element 64 is bent perpendicularly towards the plane of the circuit board.

Given built-in antenna device 60 with the above configuration, it is possible to adjust the length and the girth of dipole antenna 12 and parasitic element 64 and the distance therebetween to predetermined levels, so as to subject the self impedance of dipole antenna 12, the self impedance of parasitic element 64, and the mutual impedance between dipole antenna 12 and parasitic element 64 to change. By this means, the input impedance of built-in antenna 60 can also be subjected to change so as to broaden bandwidth.

Moreover, one end of parasitic element 64 is bent in the direction of the front side of case 15 like dipole antenna 12, while the other end is bent towards the depth of case 15, which is contrary to dipole antenna 12, and, in addition, a middle portion of parasitic element 64 is bent perpendicularly towards the plane of the circuit board. By this means, the transmission/reception of vertical polarized waves in the length direction and in the thickness direction of the case is made possible without creating antiphase antenna currents in the length direction and in the thickness direction of the case.

The present embodiment is thus capable of broadening bandwidth, and further miniaturization and thin modeling of a built-in antenna device, without modifying the shape of a dipole antenna element in a thick board shape or such. Moreover, the transmission/reception of vertical polarized waves in the thickness direction of a case is made possible.

Seventh Embodiment

One principal feature of the built-in antenna device of the seventh embodiment of the present invention is that a parasitic element is provided with a lumped constant, so as to change the ratio of transmission/reception strength and sensitivity of every polarized wave.

Figure 7:
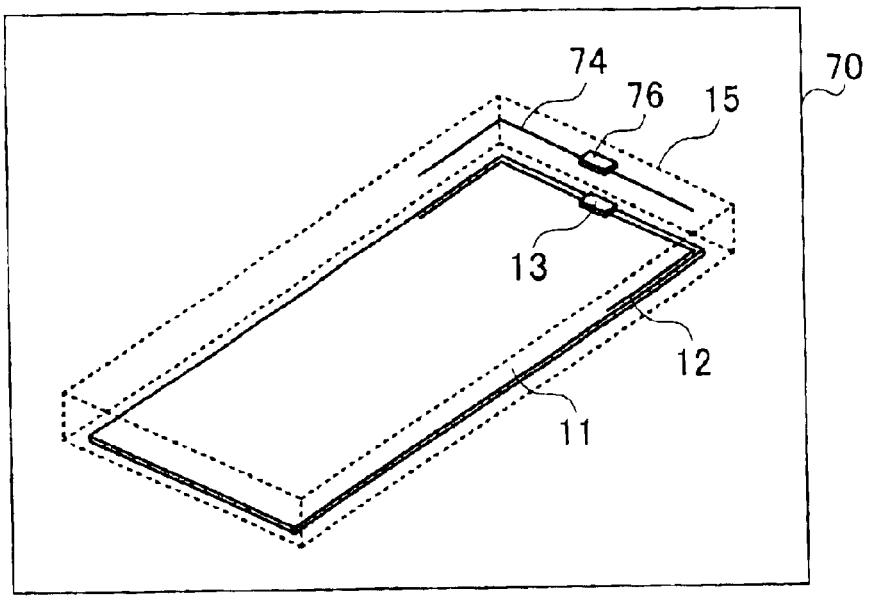
FIG. 7 shows a configuration of a built-in antenna device according to the seventh embodiment of the present invention.

FIG. 7 shows a configuration of a built-in antenna device according to the seventh embodiment of the present invention. Parts in FIG. 7 identical to those of FIG. 1 are assigned the same numerals as in FIG. 1 without further explanations.

Built-in antenna device 70 comprises circuit board 11, dipole antenna 12, balun 13, parasitic element 74, case 15, and lumped constant 76. Hereinafter the length direction of case 15 shall be construed such that the direction where dipole antenna 12, balun 13, and parasitic element 74 lie is the depth side, and the direction where dipole antenna 12, balun 13, and parasitic element 74 are not provided is the front side.

Parasitic element 74 is provided on the inner wall of case 15 in direct opposition to dipole antenna 12 on circuit board 11. Like dipole antenna 12, one end of parasitic element 74 is bent in the direction of the front side of case 15, while the other end is not bent, so that parasitic element 74 as a whole makes an L shape. In addition, parasitic element 74 is provided with lumped constant 76.

Given built-in antenna device 70 with the above configuration, it is possible to adjust the length and the girth of dipole antenna 12 and parasitic element 74 and the distance therebetween to predetermined levels, so as to subject the self impedance of dipole antenna 12, the self impedance of parasitic element 74, and the mutual impedance between dipole antenna 12 and parasitic element 74 to change. By this means, the input impedance of built-in antenna 70 can also be subjected to change so as to broaden bandwidth.

Moreover, one end of parasitic element 74 is bent in the direction of the front side of case 15 like dipole antenna 12, while the other end is not bent, so that parasitic element 74 as a whole makes an L shape. By this means, the transmission/reception of vertical polarized waves in the length direction of the case is made possible without creating antiphase antenna currents in the length direction of the case. In addition, parasitic element 74 is provided with lumped constant 76. By this means, the electrical length ratio of the bent portion and the unbent portion can be changed, so that the ratio of transmission/reception strength and sensitivity between horizontal waves and vertical polarized waves can also be subjected to change.

The present embodiment is thus capable of broadening bandwidth, and further miniaturization and thin modeling of a built-in antenna device, without modifying the shape of a dipole antenna element in a thick board shape or such. Moreover, the transmission/reception of vertical polarized waves in the thickness direction of a case is made possible. In addition, providing a parasitic element with a lumped constant makes it possible to change the ratio of strength and sensitivity in varying directions where polarized waves are transmitted and received.

Eighth Embodiment

One principal feature of the built-in antenna device of the eighth embodiment of the present invention is that a parasitic element is provided with a lumped constant and disposed on a circuit board plane, for further miniaturization and thin modeling of the device.

Figure 8:
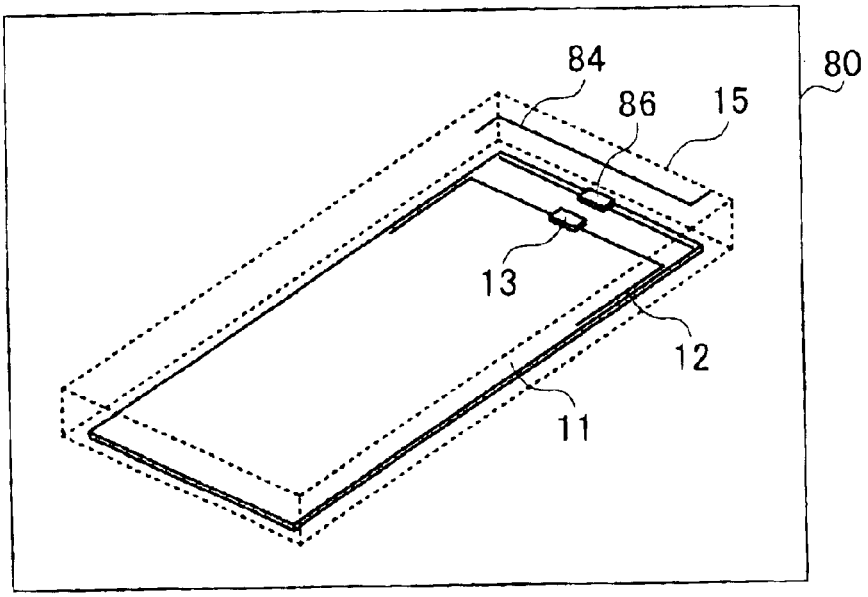
FIG. 8 shows a configuration of a built-in antenna device according to the eighth embodiment of the present invention.

FIG. 8 shows a configuration of a built-in antenna device according to the eighth embodiment of the present invention. Parts in FIG. 8 identical to those of FIG. 1 are assigned the same numerals as in FIG. 1 without further explanations.

Built-in antenna device 80 comprises circuit board 11, dipole antenna 12, balun 13, parasitic element 84, case 15, and lumped constant 86.

Parasitic element 84 is provided on circuit board 11 near dipole antenna 12. Parasitic element 84 is provided with lumped constant 86.

Given built-in antenna device 80 with the above configuration, it is possible to adjust the length and the girth of dipole antenna 12 and parasitic element 84 and the distance therebetween to predetermined levels, so as to subject the self impedance of dipole antenna 12, the self impedance of parasitic element 84, and the mutual impedance between dipole antenna 12 and parasitic element 84 to change. By this means, the input impedance of built-in antenna 80 can also be subjected to change so as to broaden bandwidth.

Since parasitic element 84 is provided with lumped constant 86, it is possible to change the electrical length of parasitic element 84 and make the length of parasitic element 84 in the short direction of the case within the length of the short direction of circuit board 11. By this means, the device can be made further small and thin.

The present embodiment is thus capable of broadening bandwidth, and further miniaturization and thin modeling of a built-in antenna device, without modifying the shape of a dipole antenna element in a thick board shape or such.

Ninth Embodiment

One principal feature of the built-in antenna device of the ninth embodiment of the present invention is that a reflector is provided in direct opposition to a parasitic element over a dipole antenna, so as to enhance gain and reduce SAR.

Figure 9:
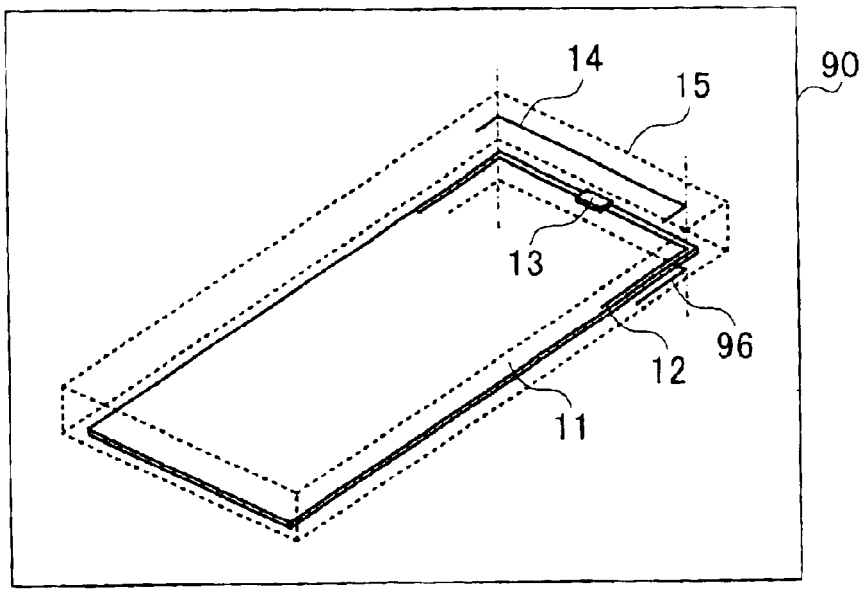
FIG. 9 shows a configuration of a built-in antenna device according to the ninth embodiment of the present invention.

FIG. 9 shows a configuration of a built-in antenna device according to the ninth embodiment of the present invention. Parts in FIG. 9 identical to those of FIG. 1 are assigned the same numerals as in FIG. 1 without further explanations.

Built-in antenna device 90 comprises circuit board 11, dipole antenna 12, balun 13, parasitic element 14, case 15, and reflector 96.

Reflector 96 is positioned in direct opposition to parasitic element 14 over circuit board 11 and dipole antenna 12. However, reflector 96, as long as it is opposite to circuit board 11 and dipole antenna 12, can be provided on the inner wall of case 15 or on the back of circuit board 11.

Given built-in antenna device 90 with the above configuration, it is possible to adjust the length and the girth of dipole antenna 12 and parasitic element 14 and the distance therebetween to predetermined levels, so as to subject the self impedance of dipole antenna 12, the self impedance of parasitic element 14, and the mutual impedance between dipole antenna 12 and parasitic element 14 to change. By this means, the input impedance of built-in antenna 90 can also be subjected to change so as to broaden bandwidth.

Since parasitic element 14 and reflector 96 are positioned opposite to each other over circuit board 11 and dipole antenna 12, built-in antenna device 90 acquires a directivity in the thickness direction of the case, thereby enhancing gain and reducing SAR.

The present embodiment is thus capable of broadening bandwidth, enhancing gain, and reducing SAR with additional directivity, without modifying the shape of a dipole antenna element into a thick board shape or such.

Tenth Embodiment

One principal feature of the built-in antenna device of the tenth embodiment of the present invention is that a number of reflectors are provided opposite from a parasitic element over a dipole antenna, so as to enhance gain and reduce SAR.

Figure 10:
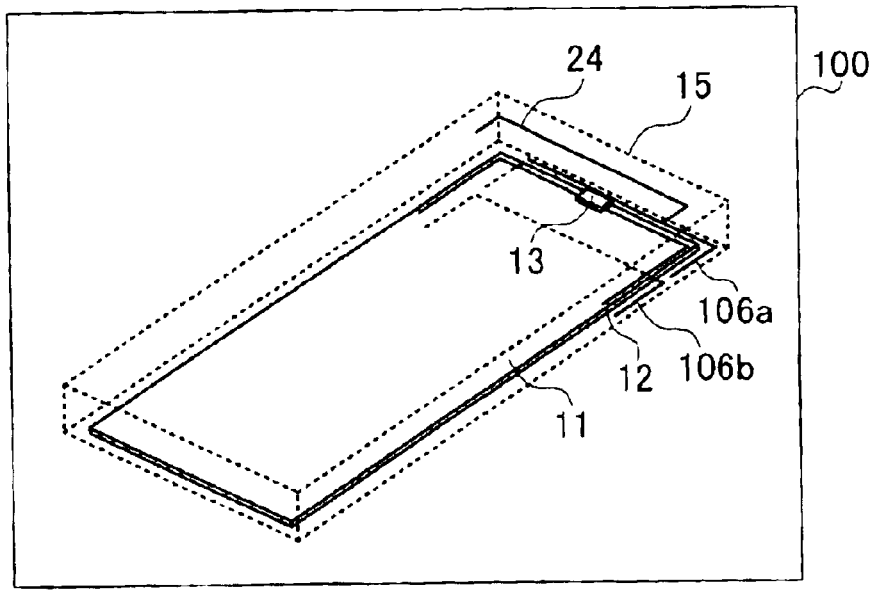
FIG. 10 shows a configuration of a built-in antenna device according to the tenth embodiment of the present invention.

FIG. 10 shows a configuration of a built-in antenna device according to the tenth embodiment of the present invention. Parts in FIG. 10 identical to those of FIG. 1 are assigned the same numerals as in FIG. 1 without further explanations.

Built-in antenna device 100 comprises circuit board 11, dipole antenna 12, balun 13, parasitic element 14, case 15, and reflectors 106*a* and 106*b*.

Reflectors 106*a* and 106*b* are provided in pair opposite to parasitic element 14 over circuit board 11 and dipole antenna 12. However, reflectors 106*a* and 106*b*, as long as they are opposite from parasitic element 14 over circuit board 11 and dipole antenna 12, can be provided on the inner wall of case 15 or on the back of circuit board 11.

Given built-in antenna device 100 with the above configuration, it is possible to adjust the length and the girth of dipole antenna 12 and parasitic element 14 and the distance therebetween to predetermined levels, so as to subject the self impedance of dipole antenna 12, the self impedance of parasitic element 14, and the mutual impedance between dipole antenna 12 and parasitic element 14 to change. By this means, the input impedance of built-in antenna 100 can also be subjected to change so as to broaden bandwidth.

Since parasitic element 14 and reflectors 106*a* and 106*b* are positioned opposite to each other over circuit board 11 and dipole antenna 12, built-in antenna device 100 acquires a directivity in the thickness direction of the case, which then leads to enhanced gain and reduced SAR.

The present embodiment is thus capable of broadening bandwidth, enhancing gain, and reducing SAR with additional directivity, without modifying the shape of a dipole antenna element into a thick board shape or such.

Eleventh Embodiment

One principal feature of the built-in antenna device of the eleventh embodiment of the present invention is to make a portion of a case with steel so as to enhance gain and reduce SAR.

Figure 11:
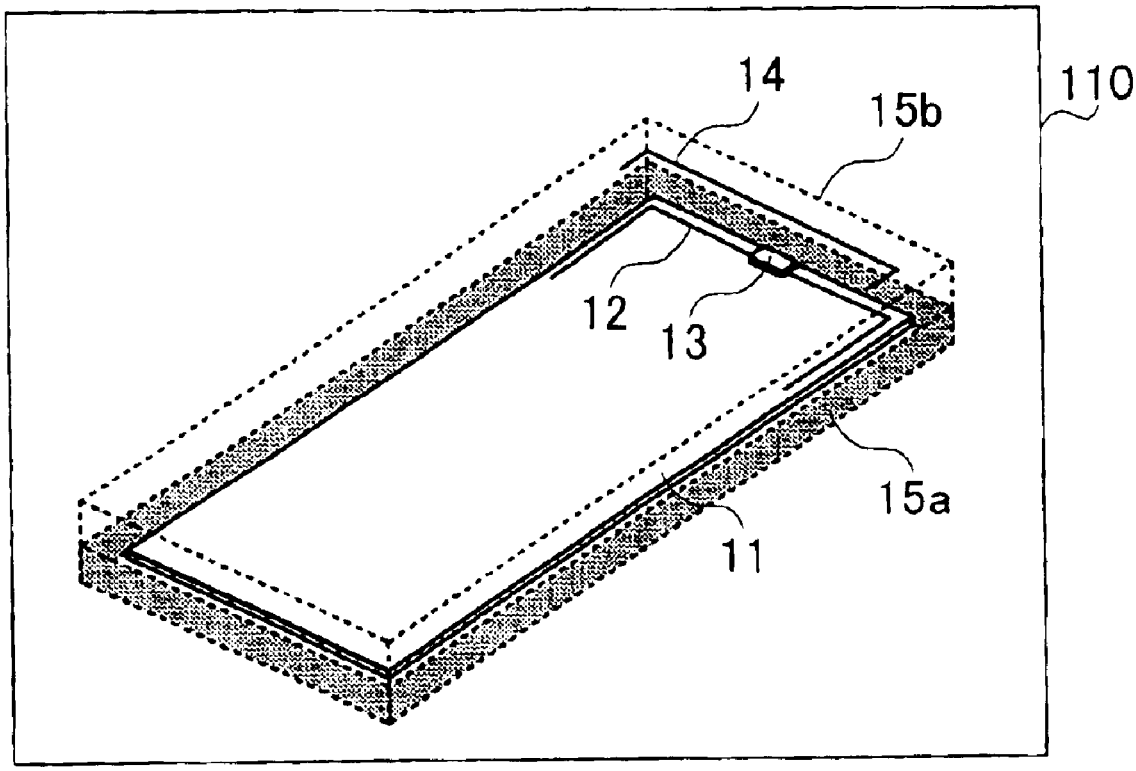
FIG. 11 shows a configuration of a built-in antenna device according to the eleventh embodiment of the present invention.

FIG. 11 shows a configuration of a built-in antenna device according to the eleventh embodiment of the present invention. Parts in FIG. 11 identical to those of FIG. 1 are assigned the same numerals as in FIG. 1 without further explanations.

Built-in antenna device 110 comprises circuit board 11, dipole antenna 12, balun 13, parasitic element 14, steel cover 15*a*, and resinous cover 15*b*.

The case of a built-in antenna device of the present embodiment is configured such that steel cover 15*a* is the opposite side to parasitic element 14 in relation to circuit board 11 and dipole antenna 12, and resinous cover 15*b* is the same side as parasitic element 14 in relation to circuit board 11 dipole antenna 12.

Given built-in antenna device 110 with the above configuration, it is possible to adjust the length and the girth of dipole antenna 12 and parasitic element 14 and the distance therebetween to predetermined levels, so as to subject the self impedance of dipole antenna 12, the self impedance of parasitic element 14, and the mutual impedance between dipole antenna 12 and parasitic element 14 to change. By this means, the input impedance of built-in antenna 110 can also be subjected to change so as to broaden bandwidth.

Since steel cover 15*a* that is opposite to parasitic element 14 over circuit board 11 and dipole antenna 12 functions as a reflection board, built-in antenna device gains a directivity in the thickness direction of the case, thereby enhancing gain and reducing SAR.

The present embodiment is thus capable of broadening bandwidth, and further miniaturization and thin modeling of a built-in antenna device, without modifying the shape of a dipole antenna element into a thick board shape or such. Moreover, adding a directivity makes it possible to enhance gain and reduce SAR.

The above-described modes of embodiment can be combined with each other. That is, modifying the shape a parasitic element, providing a parasitic element with a lumped constant, the position of a reflector, and the use of a steel cover can be implemented in combination.

Furthermore, the above first through sixth embodiments show configurations in which the shape of a parasitic element is modified only in typical manners. However, it is still possible to modify the shape of a parasitic element in various other ways and transmit and receive polarized waves in and from the directions of interest.

As described above, the present invention is capable of broadening bandwidth and realizing further miniaturization and thin modeling without making the whole device in a flat shape.

Furthermore, the present invention makes a device smaller and thinner without making the whole device in a flat shape, and still achieves enhanced gain and reduced SAR.

The present invention is based on Japanese Patent Application No. 2001-225104 filed on Jul. 25, 2001, and Japanese Patent Application No. 2002-080569 filed on Mar. 22, 2002, entire content of which is expressly incorporated herein for reference.

Industrial Applicability

The present invention is applicable to built-in antenna devices.

What is claimed is:

1. A built-in antenna device comprising:

a radiation element of a dipole configuration that is supplied power and provided on a circuit board, both ends of said radiation element turned in a same direction;

a parasitic element for use in matching provided opposite to said radiation element, both ends of said parasitic element bent to the same direction as said both ends of said radiation element; and a case current suppressor provided in a power supply part of said radiation element to suppress a case current.

2. The built-in antenna device according to claim 1, wherein an unbent portion of said parasitic element has a part in a shape of a step that is perpendicular towards a plane of said circuit board.

3. The built-in antenna device according to claim 1, wherein said parasitic element is provided with a lumped constant.

4. The built-in antenna device according to claim 1, wherein a reflection element is provided opposite to said parasitic element over said radiation element.

5. The built-in antenna device according to claim 1, further comprising a case, at least a portion of which that is opposite to said parasitic element over said radiation element is made of steel.

6. A built-in antenna device comprising:

a radiation element of a dipole configuration that is supplied power and provided on a circuit board, both ends of said radiation element turned in a same direction;

a parasitic element for use in matching provided opposite to said radiation element, one end of said parasitic element bent to the same direction as said both ends of said radiation element, and the other end bent to an opposite direction; and a case current suppressor provided in a power supply part of said radiation element to suppress a case current.

7. The built-in antenna device according to claim 6, wherein an unbent portion of said parasitic element has a part in a shape of a step that is perpendicular towards a plane of said circuit board.

8. The built-in antenna device according to claim 6, wherein said parasitic element is provided with a lumped constant.

9. The built-in antenna device according to claim 6, wherein a reflection element is provided opposite to said parasitic element over said radiation element.

10. The built-in antenna device according to claim 6, further comprising a case, at least a portion of which that is opposite to said parasitic element over said radiation element is made of steel.

11. A built-in antenna device comprising:

a radiation element of a dipole configuration that is supplied power and provided on a circuit board, both ends of said radiation element turned in a same direction;

a parasitic element for use in matching provided opposite to said radiation element, only one end of said parasitic element bent to the same direction as said both ends of said radiation element; and a case current suppressor provided in a power supply part of said radiation element to suppress a case current.

12. The built-in antenna device according to claim 11, wherein an unbent portion of said parasitic element has a part in a shape of a step that is perpendicular towards a plane of said circuit board.

13. The built-in antenna device according to claim 11, wherein said parasitic element is provided with a lumped constant.

14. The built-in antenna device according to claim 11, wherein a reflection element is provided opposite to said parasitic element over said radiation element.

15. The built-in antenna device according to claim 11, further comprising a case, at least a portion of which that is opposite to said parasitic element over said radiation element is made of steel.

16. A built-in antenna device comprising:

a radiation element of a dipole configuration that is supplied power and provided on a circuit board, both ends of said radiation element turned in a same direction;

a parasitic element for use in matching provided opposite to said radiation element, one end of said parasitic element bent to the same direction as said both ends of said radiation element, and the other end bent to a direction that is perpendicular to a plane of said circuit board; and a case current suppressor provided in a power supply part of said radiation element to suppress a case current.

17. The built-in antenna device according to claim 16, wherein said parasitic element is provided with a lumped constant.

18. The built-in antenna device according to claim 16, wherein a reflection element is provided opposite to said parasitic element over said radiation element.

19. The built-in antenna device according to claim 16, further comprising a case, at least a portion of which that is opposite to said parasitic element over said radiation element is made of steel.

20. A built-in antenna device comprising:

a radiation element of a dipole configuration that is supplied power and provided on a circuit board, both ends of said radiation element turned in a same direction;

a parasitic element for use in matching provided near said radiation element on said circuit board; and a case current suppressor provided in a power supply part of said radiation element to suppress a case current.

21. The built-in antenna device according to claim 20, wherein said parasitic element is provided with a lumped constant.

22. The built-in antenna device according to claim 20, further comprising a case, at least a portion of which that is opposite to said parasitic element over said radiation element is made of steel.

23. A built-in antenna device comprising:

a radiation element of a dipole configuration that is supplied power and provided on a circuit board, both ends of said radiation element turned in a same direction;

a case, at least a portion of which that is opposite to said radiation element over said circuit board is made of steel; and a case current suppressor provided in a power supply part of said radiation element to suppress a case current.

24. The built-in antenna device according to claim 23, wherein said radiation element is provided with a lumped constant.

25. A built-in antenna device comprising:

a radiation element of a dipole configuration that is supplied power and provided on a circuit board, both ends of said radiation element turned in mutually opposite directions;

a case, at least a portion of which that is opposite to said radiation element over said circuit board is made of steel; and a case current suppressor provided in a power supply part of said radiation element to suppress a case current.

26. The built-in antenna device according to claim 25, wherein said radiation element is provided with a lumped constant.

* * * * *